US005995917A

United States Patent [19]

Hill

[11] Patent Number: 5,995,917

[45] **Date of Patent: *Nov. 30, 1999**

[54] OPTIMAL RING ANTENNA DETERMINATION SYSTEM

[75] Inventor: Robert J. Hill, Fremont, Calif.

[73] Assignee: Trimble Navigation Limited, Sunnyvale, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/694,931

[22] Filed: Aug. 8, 1996

[51] Int. Cl.[6] ..... H01Q 21/00

[52] U.S. Cl. ..... 702/183; 702/66; 343/844; 364/140.09

[58] Field of Search ..... 343/700, 767, 343/770, 780, 844; 364/140, 140.02, 140.09, 578, 802; 395/500; 702/65, 66, 69, 71, 74, 106, 107, 117, 118, 150, 151, 157, 158, 182–184; 342/379

[56] References Cited

U.S. PATENT DOCUMENTS

| | | | |
|---|---|---|---|
| 3,780,372 | 12/1973 | Unz | 343/846 |
| 3,789,417 | 1/1974 | Coleman | 343/816 |
| 5,028,933 | 7/1991 | Stangel | 343/771 |

OTHER PUBLICATIONS

Micro Computer Tool for Communication Engineering Shing Ted Li, John W. Rockway, James C. Logan, Daniel W.S. Tam 1983 Artech House, Inc. Preface, Chapter 4. (No month).

*Primary Examiner*—Hal Wachsman
*Attorney, Agent, or Firm*—Wagner, Murabito & Hao LLP

[57] ABSTRACT

A system and method for determining the minimum number of radiating elements required to achieve desired operating characteristics for a circular array of radiating elements. In one embodiment, the present invention determines the number of radiating elements required to space the radiating elements about the periphery of a circle such that a circular array of radiating elements is generated. The radiating elements are spaced apart from each other by a distance which is related to the wavelength of radiation at which the radiating elements operate. The present invention evaluates the maximum and minimum electric field strength generated by the circular array of radiating elements. By comparing the maximum field strength to the minimum field strength, the present invention measures the maximum ripple generated by the circular array of radiating elements. The maximum ripple generated by the circular array of radiating elements is then compared with a predetermined acceptable ripple level. The present invention adjusts the number of radiating elements spaced about the periphery of the circle until the maximum ripple generated by the circular array of radiating elements is less than or equal to the predetermined acceptable ripple level. In so doing, the present invention determines the minimum number of radiating elements required to achieve desired operating characteristics for the circular array of radiating elements.

18 Claims, 8 Drawing Sheets

10 dB/div

6 Radiating Elements
Ripple = ± 3.1 dB 10 dB/div

9 Radiating Elements
Ripple = ± 0 dB

OPTIMAL RING ANTENNA DETERMINATION SYSTEM

TECHNICAL FIELD

This invention relates to a circular antenna system. Specifically, the present invention relates to determining the minimum number of radiating elements needed to achieve desired operating characteristics for a circular array of radiating elements.

BACKGROUND ART

Point source radiating elements such as, for example, patch antennas are well known in the art. In some applications, it is desirable to arrange a plurality of point source radiating elements into an array. As an example, point source radiating elements can be arranged in a ring-shaped array to form an omnidirectional antenna. However, when multiple radiating elements are placed in an array, constructive and destructive interference affects the radiation pattern generated by the array.

In Prior Art FIG. 1, a ring-shaped array 100 of patch antennas, typically shown as 102, generates a specific radiation pattern 104. Radiation pattern 104 indicates the outermost distance from the center of ring-shaped array 100 to which radiation having a specific power level extends. For example, pattern 104 represents the outermost distance from the center of ring-shaped array 100 at which radiation having a power level of 10 dB can be detected. As shown in Prior Art FIG. 1, radiation pattern 104 is not uniform about the center of ring-shaped array 100. Points $P_1$ and $P_2$ represent receivers having the ability to receive radiation having a power level of 10 dB or greater. In Prior Art FIG. 1, points $P_1$ and $P_2$ are equidistant from the center of ring-shaped array 100. In the example of Prior Art FIG. 1, a receiver located at point $P_1$ is able to receive radiation transmitted by ring-shaped array 100, while a receiver at point $P_2$ is outside of the range to which radiation having power level of 10 dB or greater is transmitted. Therefore, a receiver located at point $P_2$ is not able to receive radiation transmitted by ring-shaped array 100. Thus, even though points $P_1$ and $P_2$ are equidistant from the center of ring-shaped array 100, only one of the receivers can communicate with ring-shaped array 100.

The radiation pattern generated by a ring-shaped array differs greatly depending upon various features of the ring-shaped array. Such radiation pattern affecting features include, but are not limited to, the number, location, power and phase distribution, and frequency of each of the patch antennas. Other factors such as the diameter of the ring-shaped array also influence the generated radiation pattern.

In many applications, it is desirable to manipulate the radiation pattern generated by the ring-shaped array. For example, it may be desired to reduce the radiation pattern variation referred to as "ripple." By significantly reducing ripple, the power level of radiation is more uniformly distributed about the periphery of the ring-shaped array. For example, by reducing ripple in the embodiment of Prior Art FIG. 1, both of receivers $P_1$ and $P_2$ would be able to receive radiation transmitted from ring-shaped array 100. In one prior art attempt to reduce ripple, changes are made to various constraints of the ring-shaped array. The newly configured ring-shaped array is then experimentally tested to see if desired results are achieved. The experimentation process is continued until the desired results are obtained. Although such an experimental approach can produce a ring-shaped array which complies with desired results, such an approach is labor intensive, time-consuming, and error prone. That is, prior art approaches commonly require repeated construction and testing of the ring-shaped array. Additionally, prior art experimental approach processes do not necessarily determine the minimal number of radiating elements needed in the ring-shaped array to achieve the desired results. That is, an experimentation approach may produce an array which contains more radiating elements than is necessary to achieve desired operating characteristics. As a result, the array includes unnecessary cost, weight, and size.

Thus, a need exists for a method and system which determines the required placement of radiating elements about an array in order to achieve desired operating characteristics wherein the method and system does not require repeated experimentation. A further need exists for a method and system which determines the minimum number of radiating elements required to achieve desired operating characteristics for various circular arrays having respective various structural and functional features.

DISCLOSURE OF THE INVENTION

The present invention provides a method and system which determines the required placement of radiating elements about an array in order to achieve desired operating characteristics wherein the method and system does not require repeated experimentation. The present invention further provides a method and system which determines the minimum number of radiating elements required to achieve desired operating characteristics for various circular arrays having respective various structural and functional features. The present invention accomplishes the above achievements with a computer-implemented system and method for determining the minimum number of radiating elements required to achieve desired operating characteristics for a circular array of radiating elements.

Specifically, in one embodiment, the present invention determines the number of elements required to space the elements about the periphery of a circle such that a circular array of elements is generated. The elements are spaced apart from each other by a distance which is related to the wavelength of radiation at which the elements operate. The present invention evaluates the maximum and minimum electric field strength generated by the circular array of elements. By comparing the maximum field strength to the minimum field strength, the present invention measures the maximum ripple generated by the circular array of elements. The maximum ripple generated by the circular array of elements is then compared with a predetermined acceptable ripple level. The present invention adjusts the number of elements spaced about the periphery of the circle until the maximum ripple generated by the circular array of elements is less than or equal to the predetermined acceptable ripple level. In so doing, the present invention determines the minimum number of elements required to achieve desired operating characteristics for the circular array of radiating elements.

In another embodiment, the present invention determines the number of elements required to equally space the elements about the periphery of a circle and further separates the elements from adjacent elements by a distance which is no greater than one half the distance of the wavelength of the radiation at which the elements operate. The present invention rounds the calculated number of elements to the nearest integer. If the rounded calculated number of elements is not an odd number of elements, the present invention adds an additional element to the rounded calculated number of elements needed about the periphery of the circle. If the rounded calculated number of elements is an odd number of elements, the present invention uses the rounded calculated number of elements as the number of elements needed about the periphery of the circle. Next, the present invention evaluates the maximum and minimum electric field strength generated by the circular array of elements over 360 degrees. The present invention then measures the maximum ripple generated by the circular array of elements and compares the maximum ripple with a predetermined acceptable ripple level. Next, the present invention adjusts the number of elements spaced about the periphery of the circle until the maximum ripple generated by the circular array of elements is less than or equal to the predetermined acceptable ripple level. The number of elements is adjusted by the present invention by increasing the number of elements spaced about the periphery of the circular array when the maximum ripple is greater than the predetermined acceptable ripple level. The present invention then compares the new maximum ripple value with the predetermined acceptable ripple level. Additional elements are added by the present invention until the maximum ripple value is not greater than the predetermined acceptable ripple level. Similarly, the number of elements is adjusted by the present invention by decreasing the number of elements spaced about the periphery of the circular array when the maximum ripple is less than or equal to the predetermined acceptable ripple level. The present invention then compares the new maximum ripple value with the predetermined acceptable ripple level. The number of elements is further decreased by the present invention until the maximum ripple value is not less than or equal to the predetermined acceptable ripple level. In so doing, the present invention determines the minimum number of elements required to achieve desired operating characteristics for the circular array of radiating elements.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Figure 1:
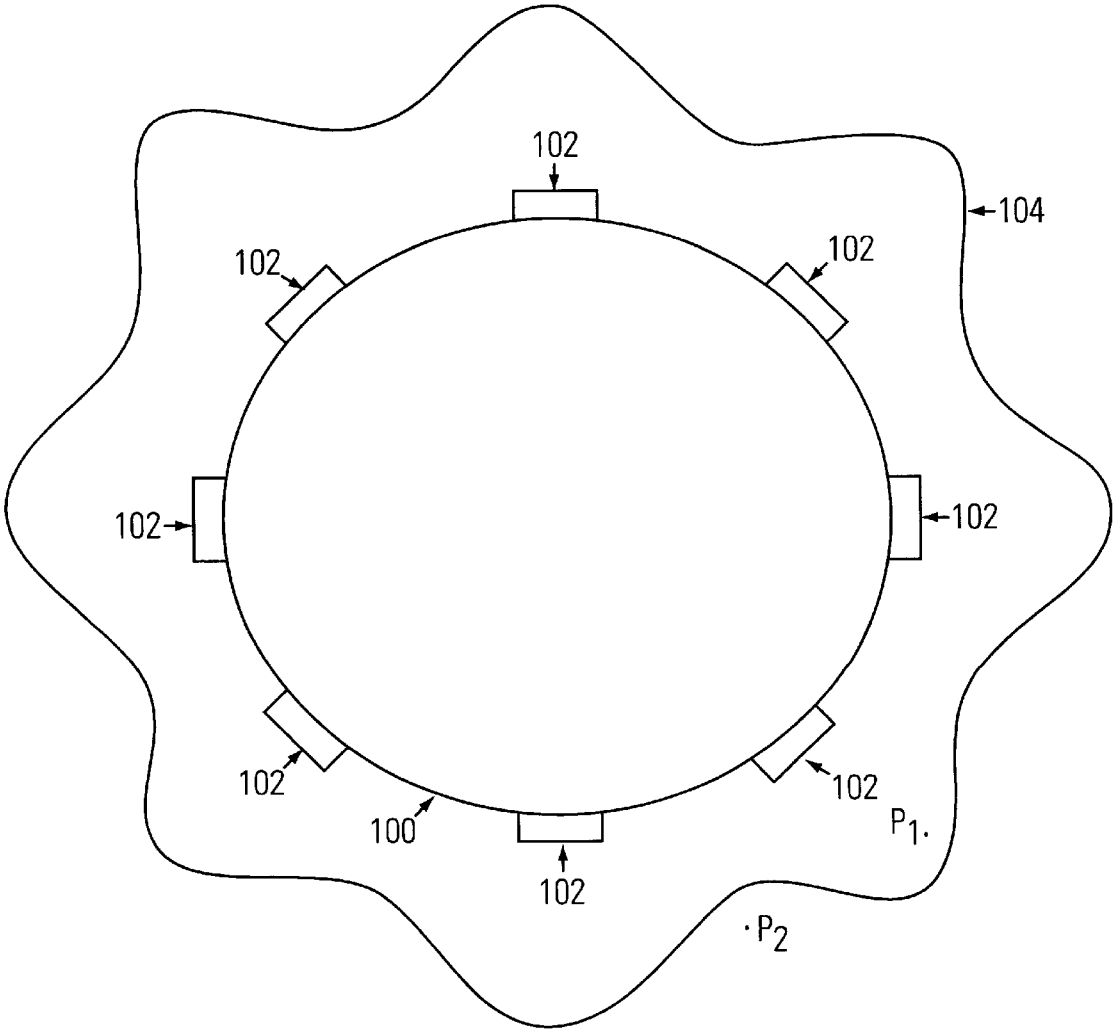
FIG. 1 (Prior Art)
FIG. 1 is a schematic diagram of a Prior Art ring-shaped array and a radiation pattern generated by the ring-shaped array.

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Some portions of the detailed descriptions which follow are presented in terms of procedures, logic blocks, processing, and other symbolic representations of operations on data bits within a computer memory. These descriptions and representations are the means used by those skilled in the data processing arts to most effectively convey the substance of their work to others skilled in the art. In the present application, a procedure, logic block, process, etc., is conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "determining," "evaluating," "measuring," "comparing," "adjusting," or the like, refer to the actions and processes of a computer system, or similar electronic computing device. The computer system or similar electronic computing device manipulates and transforms data represented as physical (electronic) quantities within the computer system's registers and memories into other data similarly represented as physical quantities within the computer system memories or registers or other such information storage, transmission, or display devices. The present invention is also well suited to the use of other computer systems such as, for example, optical and mechanical computers.

COMPUTER SYSTEM ENVIRONMENT OF THE PRESENT INVENTION

Figure 2:
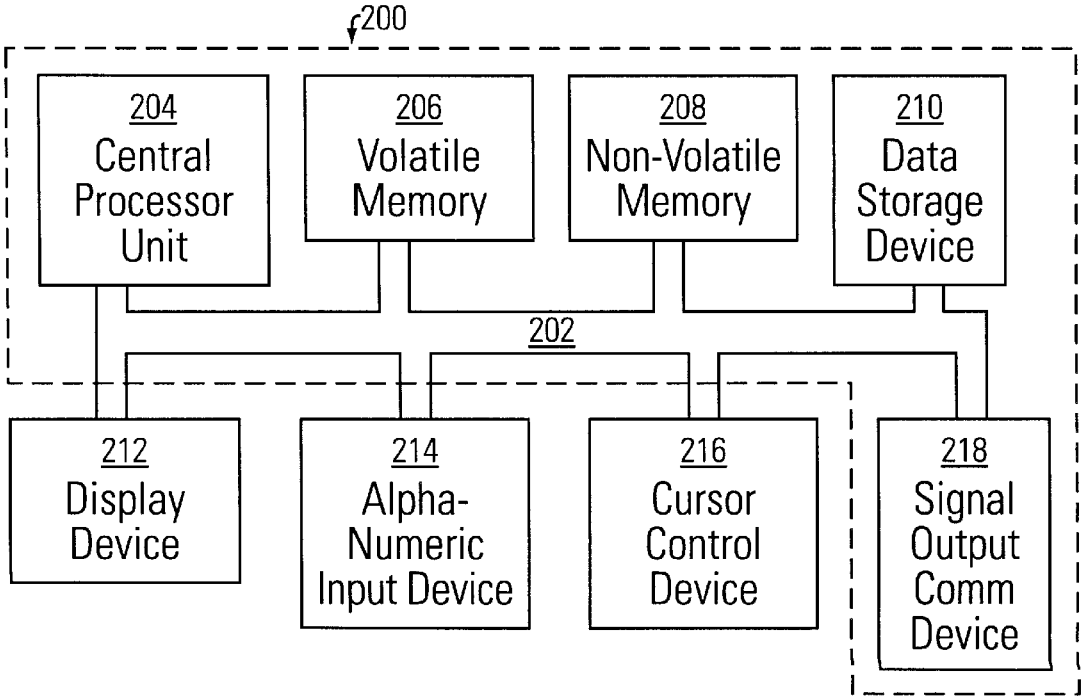
FIG. 2 is a schematic diagram of an exemplary computer system used as a part of an optimal ring antenna determination system in accordance with the present invention.

With reference now to FIG. 2, portions of the present optimal ring antenna determination (ORAD) system are comprised of computer executable instructions which reside in a computer system. FIG. 2 illustrates an exemplary computer system 200 used as a part of an ORAD system in accordance with the present invention. It is appreciated that system 200 of FIG. 2 is exemplary only and that the present invention can operate within a number of different computer systems including general purpose computers systems, embedded computer systems, and stand alone computer systems specially adapted for optimal ring antenna determination.

ORAD system 200 of FIG. 2 includes an address/data bus 202 for communicating information, and a central processor unit 204 coupled to bus 202 for processing information and instructions. ORAD system 10 also incudes data storage features such as a volatile memory 206, e.g. random access memory (RAM), coupled to bus 202 for storing information and instructions for central processor unit 204, non-volatile memory 208, e.g. read only memory (ROM), coupled to bus 202 for storing static information and instructions for the central processor unit 204, and a data storage device 200 (e.g., a magnetic or optical disk and disk drive) coupled to bus 202 for storing information and instructions. ORAD system 200 of the present embodiment also includes a display device 212 coupled to bus 202 for displaying information (e.g., a view of a radiation pattern) to the ORAD system user. An alphanumeric input device 214 including alphanumeric and function keys is coupled to bus 202 for communicating information and command selections to central processor unit 204. ORAD system 200 also includes a cursor control device 216 coupled to bus 202 for communicating user input information and command selections to central processor unit 204, and a signal input output comm device 218 (e.g. a modem) coupled to bus 202.

Display device 212 of FIG. 2, utilized with ORAD system 200 of the present invention, may be a liquid crystal device, cathode ray tube, or other display device suitable for creating graphic images and alphanumeric characters recognizable to the user. Cursor control device 216 allows the computer user to dynamically signal the two dimensional movement of a visible symbol (cursor) on a display screen of display device 212. Many implementations of cursor control device 216 are known in the art including a trackball, mouse, touch pad, joystick or special keys on alphanumeric input device 214 capable of signaling movement of a given direction or manner of displacement. Alternatively, it will be appreciated that a cursor can be directed and/or activated via input from alphanumeric input device 214 using special keys and key sequence commands. The present invention is also well suited to directing a cursor by other means such as, for example, voice commands. A more detailed discussion of the present ORAD system and the steps performed by the ORAD system is found below.

GENERAL DESCRIPTION OF THE OPTIMAL RING ANTENNA DETERMINATION SYSTEM OF THE PRESENT INVENTION

The present ORAD system provides a method for determining the minimum number of radiating elements required in an array to achieve desired operating characteristics without requiring repeated experimentation. In the present embodiment, a vertically linearly polarized omnidirectional radiation pattern is desired. It will be understood, however, that the present invention is also well suited to use with various other types of desired radiation patterns produced by a ring-shaped array.

Figure 3:
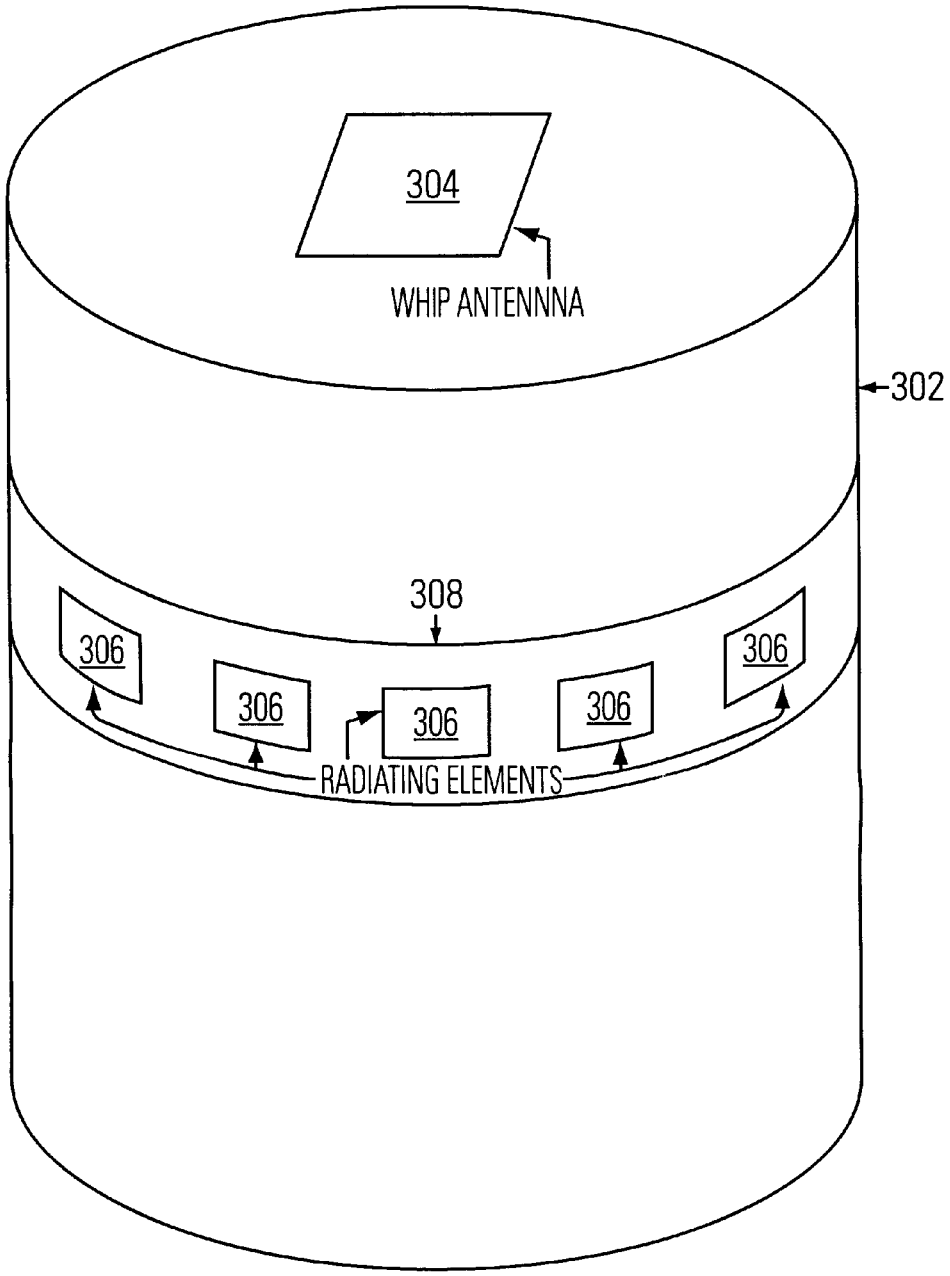
FIG. 3 is a simplified perspective view of global positioning system package having a ring-shaped array disposed on the periphery thereof in accordance with the present claimed invention.

Referring next to FIG. 3, a schematic diagram of an exemplary embodiment for which a ring-shaped array is well suited is shown. In FIG. 3, a global positioning system (GPS) receiver package 302 has a whip antenna 304 extending therefrom. Whip antenna 304 is used to receive GPS signals. If a communication system or other transmitting device is integrated with GPS receiver package 302, the radiating elements 306 of the transmitting device must be designed and oriented such that they do not interfere with reception of GPS signals by GPS receiver package 302. Thus, as shown in FIG. 3, the ring-shaped array 308 of radiating elements 306 is located around the periphery of GPS receiver package 302. Although such an arrangement is shown in FIG. 3, it will be understood that the present invention is also well suited for use with ring-shaped arrays utilized in various other applications. Furthermore, in the present embodiment, radiating elements 306 are patch antennas, however, the present invention is also well suited to the use of numerous other types of radiating elements.

Figure 4A:
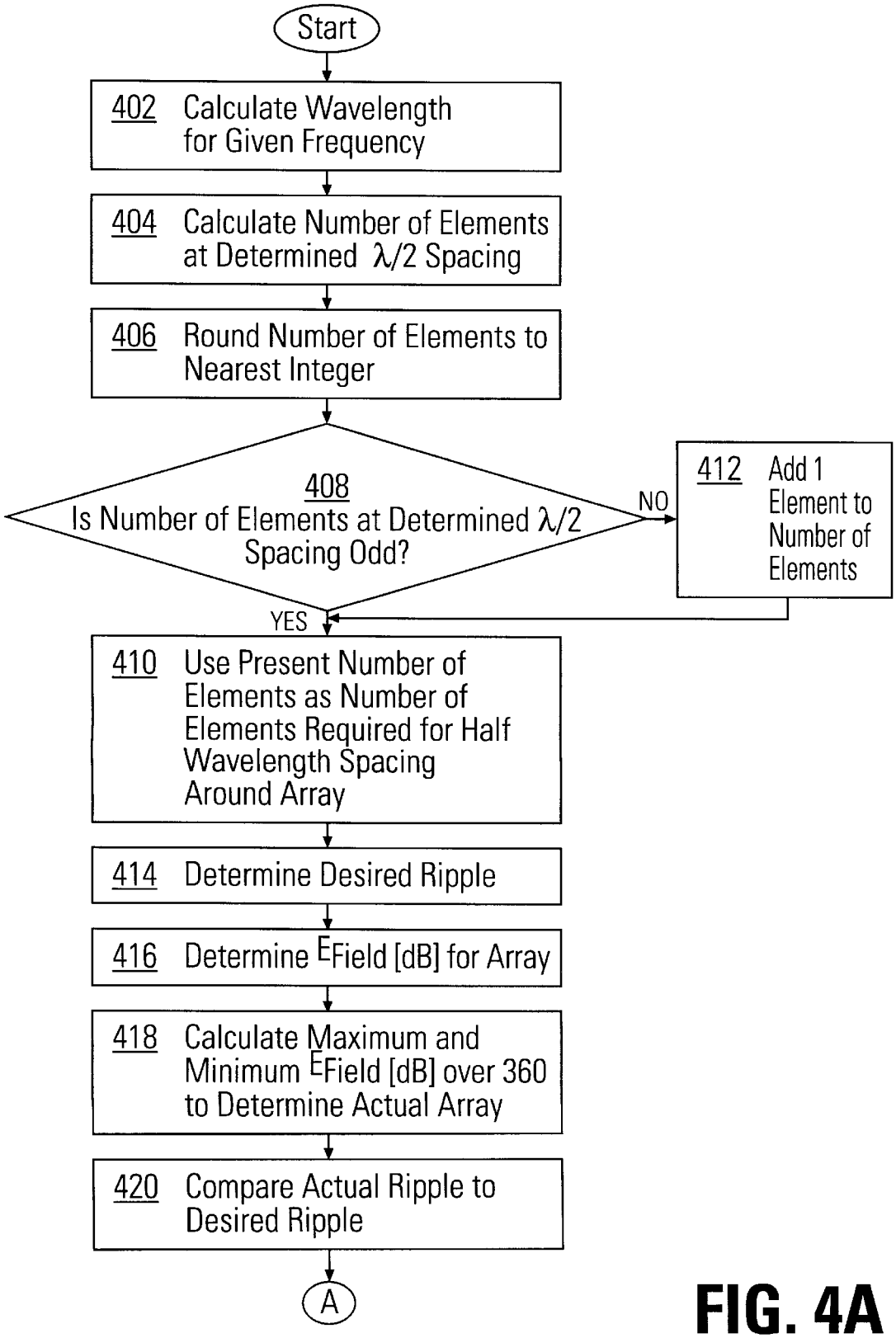
FIGS. 4A and 4B are flow charts illustrating steps employed by the optimal ring antenna determination system in accordance with the present claimed invention.
Figure 4B:
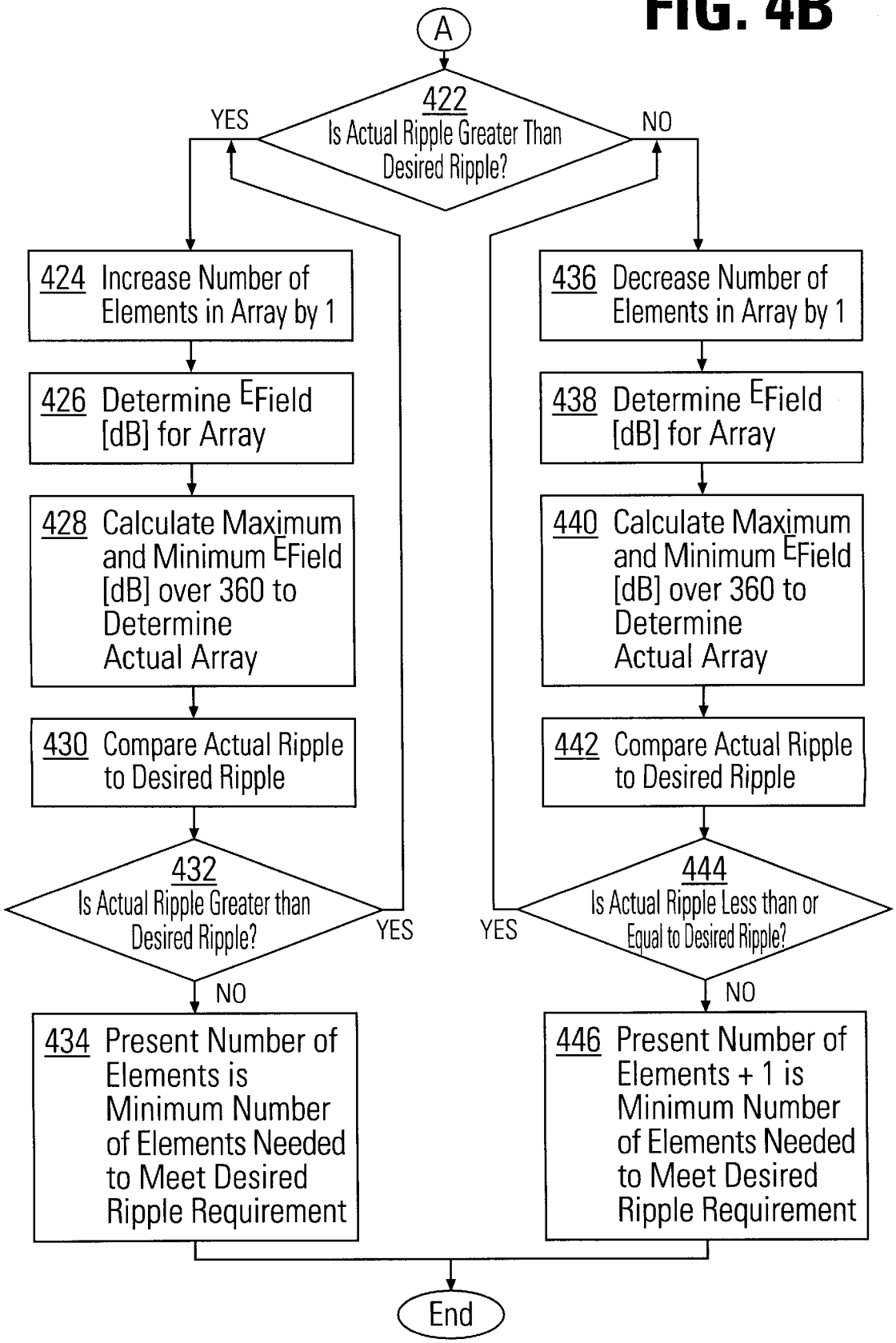

With reference next to FIGS. 4A and 4B, flow charts illustrating steps employed by the present optimal ring antenna determination (ORAD) system is shown. To initiate operation of the present invention, a user of the present ORAD system enters the diameter of the ring-shaped array and the frequency at which the radiating elements will operate. The diameter and frequency values are entered, for example, using alpha-numeric input device 214 of FIG. 2. In the present embodiment, the diameter of the ring-shaped array and the frequency of the radiating elements are given values and are fixed. Furthermore, in the present embodiment, the height of each of the radiating elements is equal to approximately one-half of the wavelength at which the radiating elements operate. Additionally, in the present embodiment, the width of the radiating elements is kept substantially shorter than the wavelength of the frequency at which the radiating elements operate. The present invention is, however, well suited to use other radiating elements having various other heights and/or widths.

As shown in step 402 of FIG. 4A, the present ORAD system calculates the wavelength of the frequency at which the radiating elements operate. More specifically, the present ORAD system uses the given frequency at which the radiating elements operate ($Freq_{GHz}$), and the speed of light ($299.79\times10^6$) to determine the wavelength of the frequency ($\lambda$). In step 402, the present ORAD system calculates the wavelength of the frequency at which the radiating elements operate as shown below:

$$wavelength(\lambda) = \frac{\text{speed of light}}{Freq_{GHZ}} = \frac{299.79\times10^6}{Freq_{GHZ}} \text{ [meters]}$$

$$wavelength(\lambda) = \left(\frac{299.79\times10^6}{Freq_{GHZ}}\right)\left(\frac{\text{m}}{\text{s}}\right)\left(\frac{1\text{ GHZ}}{1000\times10^6}\right)\left(\frac{100\text{ cm}}{\text{m}}\right)\left(\frac{1\text{ inch}}{2.54\text{ cm}}\right),$$

therefore, $$wavelength(\lambda) = \frac{11.803}{Freq_{GHZ}} \text{ [inches]}$$

With reference still to FIG. 4A, in step 404 the present ORAD system uses the wavelength derived in step 402 to calculate the number of radiating elements necessary to space the radiating elements about the periphery of the ring-shaped array. In the present embodiment, the radiating elements are positioned around the periphery of the array such that each radiating element is separated from adjacent radiating elements by a distance no greater than one-half of the wavelength derived in step 402. In so doing, the present ORAD system insures efficient transmission around the entire surface of the ring-shaped array, and also minimizes constructive and destructive interference effects between adjacent radiating elements. That is, the separation used in the present embodiment prevents phase reversals which can cause ripples in the radiation pattern of the ring-shaped array. In step 404, the present ORAD system also equally spaces the radiating elements around the surface of the ring-shaped array. Thus, in step 404, the present ORAD system uses the given diameter of the ring-shaped array in inches (d), and the derived wavelength expression from step 402, to calculates the number, N, of radiating elements as shown below.

Given that the circumference of the ring-shaped array= $2\pi r=\pi d$; and that the maximum spacing between adjacent radiating elements is $$\frac{\text{Wave Length}}{2},$$

it follows that the required number of elements N is $$\frac{\text{Circumference}}{\text{Max Spacing}} = \frac{\pi d}{\frac{\lambda}{2}} = \frac{2\pi d}{\lambda}.$$

Therefore, $$N = \frac{2\pi d}{\lambda} = \frac{2\pi d}{\frac{11.803}{Freq_{GHZ}}} = \frac{2\pi d Freq_{GHZ}}{11.803}$$

$$N = \frac{(d)(Freq_{GHZ})}{1.878}$$

$$N = \frac{(\text{diameter})(\text{Freq}_{\text{GHZ}})}{1.878}$$

In step 406 of FIG. 4A, the present ORAD system then rounds the number of radiating elements N to the next highest integer. Although such a rounding approach is used in the present embodiment, the present invention is also well suited to rounding the number of radiating elements, N, to the nearest integer, or to using various other rounding techniques well known in the art.

Next, in step 408 of FIG. 4A, the present ORAD system determines whether the rounded number N of radiating elements is even or odd. As shown by step 410, if the number N is odd, N is the number of radiating elements required for half-wavelength spacing about the ring-shaped array. On the other hand, as shown by step 412, if the number N is even, N plus one additional radiating element is the number of radiating elements required for half-wavelength spacing about the ring-shaped array. In so doing, the present ORAD system insures that the number, N, of radiating elements spaced about the ring-shaped array is odd. In the present embodiment, the ring-shaped array is placed about the periphery of a ring-shaped package such as, for example, the GPS receiver package of FIG. 3. Thus, the diameter of the ring-shaped array is given by the diameter of the outer edge of the package about which the ring-shaped array is wrapped. Likewise, the frequency of the radiating elements is also a given value in the above embodiment. The present invention is, however, well suited to varying the diameter of the ring shaped array and/or the frequency at which the radiating elements operate. The diameter of the ring-shaped array is accomplished by extending the radiating elements away from the periphery of the package around which the ring-shaped array is disposed. By varying the diameter and/or the frequency values, the operating characteristics and the number, N, of radiating elements of the ring-shaped array can be manipulated.

With reference still to FIG. 4A, in step 414 the present ORAD system then determines the desired rippled for the ring-shaped array. In the present embodiment, the ORAD system determines the desired ripple by accessing a ripple value which was previously entered into the ORAD system. The desired ripple value is entered, for example, by a user via, for example, alpha-numeric input device 214 of FIG. 2. Although the ripple value was previously entered in the present embodiment, the present ORAD system is also well suited to prompting the user with, for example display device 212 of FIG. 2, to enter the desired ripple value. Furthermore, although the desired ripple value is entered by a user in the present embodiment, the present invention is also well suited to using a specific preset ripple value. In such an embodiment, the user alters the preset value, if necessary to meet the user's desired ripple value.

Figure 5:
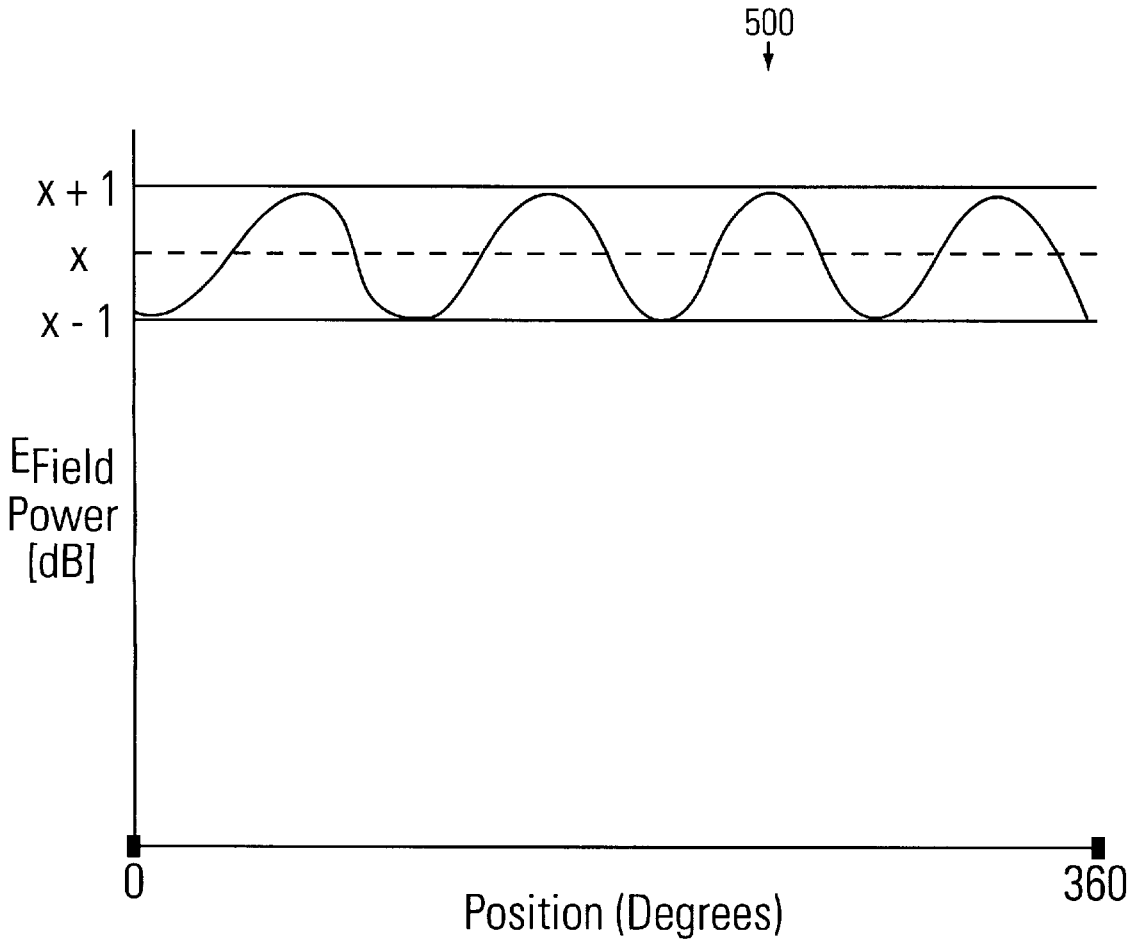
FIG. 5 is a graph of electric field, $E_{field}$, power vs. position in degrees for a typical ring-shaped array.

With reference next to FIG. 5, a graph 500 of electric field, $E_{field}$, power in decibels (dB) vs. position in degrees for a typical ring-shaped array is shown. Graph 500 shows the $E_{field}$ power vs. position comparison over 360 degrees. Thus, graph 500 illustrates the entire $E_{field}$, in two-dimensions, for a typical ring-shaped array. As shown in graph 500, the $E_{field}$ power varies from a maximum value of x+1 to a minimum value of x−1. Thus, for the exemplary embodiment of FIG. 5, the typical ring-shaped array has a maximum ripple of plus or minus 1 dB. The desired ripple entered by a user of the present ORAD system can be greater, less than, or equal to the ripple shown in graph 500. Moreover, the present invention is well suited to determining the minimal number of radiating elements needed for a ring-shaped array having no ripple. In such an embodiment, a graph of $E_{field}$ power vs. position would be a straight horizontal line. Additionally, although graph 500 extend across 360 degrees, the present ORAD system is also well suited to evaluating the power of the ring-shaped array over less than 360 degrees.

Steps 402 through 412 determine that the number of radiating elements should be N if N is odd, and N+1 if N is even. Thus, steps 402 through 412 determine the number N, or N+1, of radiating elements which will be used by the present ORAD system to calculate the $E_{field}$ for the ring-shaped array. That is, steps 402 through 412 provide a starting point for the $E_{field}$ calculations by the present ORAD system. The next step in determining the minimum number of radiating elements needed to achieve desired operating characteristics is shown in step 416. As described above, the ring-shaped array must have diameter, d, operate at a given frequency, $Freq_{GHz}$, and have zero ripple. Referring still to step 416 the present ORAD system calculates the $E_{field}$ for the ring shaped array as shown below. For purposes of clarity, the following discussion will describe the performance of the present ORAD system using N radiating elements. It will be understood that the present invention is also well suited to the use of other than N radiating elements.

In step 416, to determine the $E_{field}$ for the ring-shaped array, the present ORAD system first determines the phase contribution and the current magnitude for each of the N radiating elements. In the simplest embodiment, the ring-shaped array is powered through parallel feed network. Thus, each radiating element receives the same current magnitude at the same phase. The present invention is also well suited to an embodiment in which the radiating elements of the ring-shaped array do not receive the same current magnitude at the same phase.

To calculate the phase contribution $\gamma$ for each of the radiating elements the present ORAD system uses the relationship:

$$\gamma i=(a\lambda)(2\pi)(\cos[(\phi^0-\phi_i^0)(\pi/180)])(\sin(\theta(\pi/180)))+\alpha_i(\pi/180).$$

$a\lambda$ is the radius of the ring-shaped array in wavelengths, and is given by the formula:

$$a\lambda=\frac{(d)(Freq_{GHZ})(2.54)}{29.979}.$$

$\pi$ is, of course, approximately 3.1415927. $\phi^0$ is the azimuth angle in degrees of the of the array. In a ring-shaped array, $\phi^0$ varies from 0 to 360 degrees. $\phi_i^0$ is the azimuth angle of the ith radiating element as a function of its position around the ring-shaped array in degrees. $\theta$ is the elevation angle in degrees at which the $E_{field}$ is measured. Typically, the $E_{field}$ is measured in a plane which is perpendicular to the axis of the ring-shaped array. Therefore, $\theta$ is commonly 90 degrees. However, the present ORAD system is also well suited to determining the minimum number of radiating elements needed to achieve desired operating characteristics when $\theta$ is not equal to 90 degrees. $\alpha_i$ is the initial phase in degrees of the ith radiating element.

With reference still to step 416 of FIG. 4A, in order to calculate $E_{field}$ of the ring-shaped array, the present ORAD system determines both the real and imaginary contributions by each radiating element to the $E_{field}$. The real contribution by a first radiating element to the total $E_{field}$ is given by:

$Re[E_{field_1}]=I_1 \cos(\gamma_1)$, where $I_1$ is the current supplied to the first radiating element.

Thus, the real contribution by an ith radiating element is given by:

$Re[E_{field_i}]=I_i \cos(\gamma_i)$.

Similarly, the imaginary contribution by a first radiating element to the total $E_{field}$ is given by:

$Im[E_{field_1}]=I_1 \sin(\gamma_i)$.

The imaginary contribution by an ith radiating element is given by:

$Im[E_{field_i}]=I_i \sin(\gamma_i)$

In step 416, the present ORAD system calculates the complete real contribution by N radiating elements to the $E_{field}$ as shown below:

$Re[E_{field_{TOTAL}}]=Re[E_{field_1}]+Re[E_{field_2}]+\ldots Re[E_{field_N}]$, thus $$Re[E_{field_{TOTAL}}]=\sum_{i=1}^{n} Re[E_{field_i}].$$

Also in step 416, the present invention calculates the complete imaginary contribution by N radiating elements to the $E_{field}$ a shown below:

$Im[E_{field_{TOTAL}}]=Im[E_{field_1}]+Im[E_{field_2}]+\ldots Im[E_{field_N}]$, therefore $$Im[E_{field_{TOTAL}}]=\sum_{i=1}^{n} Im[E_{field_i}].$$

From the above equations, the present ORAD system calculates the total $E_{field}$ magnitude as:

Total Field Magnitude$=[(Re[E_{field_{TOTAL}}])^2+(Im[E_{field_{TOTAL}}])^2]^{1/2}$ Referring still to step 416 of FIG. 4A, the present ORAD system then calculates the total $E_{field}$ power, $E_{field}$ [dB] using the relationship:

$E_{field}$ [dB]=10 log [(Total Field Magnitude)$^2$].

Thus, in step 416, the present ORAD system calculates the $E_{field}$ for the ring-shaped array having N radiating elements using the above relationships.

Next, in step 418, the present ORAD system calculates the minimum and maximum $E_{field}$ [dB] for the array by subtracting the minimum $E_{field}$ [dB] value from the maximum $E_{field}$ [dB] value. The present invention determines the actual ripple for the ring-shaped array having N radiating elements and operating at the conditions listed above.

In step 420, the present ORAD system compares the actual ripple with the desired ripple. That is, the present invention compares the actual ripple determined in step 418 with the desired ripple value which was accessed in step 414.

At step 422, the present invention evaluates whether the actual ripple value obtained using N radiating elements is greater than the desired ripple.

After step 422, if the actual ripple value is greater than the desired ripple, the present invention performs step 424. In step 424, the number N of radiating elements equally spaced around the ring-shaped array is increased by one radiating element. Thus, the position of each of original N radiating elements is adjusted to accommodate addition of another radiating element. The N+1 radiating elements are equally spaced about the periphery of the ring-shaped array.

Figure 6:
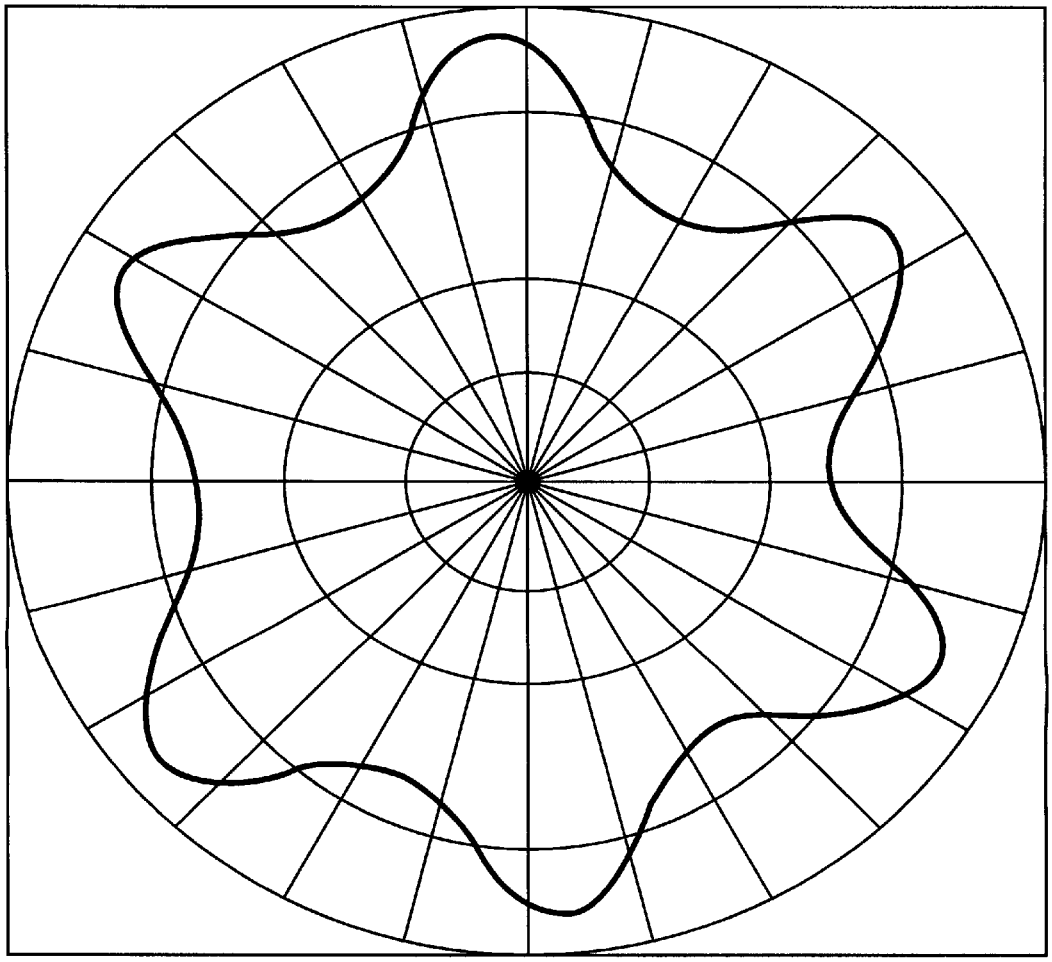
FIG. 6 is a graphic representation of a radiation pattern having a ripple value greater than a desired ripple value.

With reference next to FIG. 6, a graphic representation of a radiation pattern having a ripple value greater than the desired ripple value is shown. In the present embodiment, the desired ripple value is plus or minus 0.30 dB. In the embodiment of FIG. 6, 6 radiating elements generate a radiation pattern having a maximum ripple of plus or minus 3.1 dB. Thus, in step 424 the number of radiating elements in the embodiment of FIG. 6 would be increased by one radiating element.

Referring now to FIG. 4B, in step 426, the present ORAD system calculates the $E_{field}$ for an array having an additional radiating element. The calculation of the $E_{field}$ is accomplished as described in detail above in conjunction with step 416.

Next, in step 428, the present ORAD system calculates the minimum and maximum $E_{field}$ [dB] for the array by subtracting the minimum $E_{field}$ [dB] value from the maximum $E_{field}$ [dB] value.

In step 430, the present ORAD system compares the actual ripple with the desired ripple. That is, the present invention compares the actual ripple determined in step 428 with the desired ripple value which was accessed in step 414.

At step 432, the present invention evaluates whether the actual ripple value obtained using N radiating elements is greater than the desired ripple. If the actual ripple value is still greater than the desired ripple value, the present ORAD system repeats step 424 through 432. That is, the present ORAD system continues determining the actual ripple for increasingly larger numbers of radiating elements until the actual ripple is not greater than the desired ripple value. Once the actual ripple is not greater than the desired ripple, the present number of radiating elements is the minimum number of radiating elements needed to achieve desired operating characteristics. Thus, the present ORAD system is able to determine the minimum number of radiating elements required to achieve desired operating characteristics without requiring repeated construction and testing of actual ring-shaped arrays.

With reference again to step 422, if the initial actual ripple is not greater than the desired ripple, the present ORAD system the present invention performs step 436. In step 436, the number N of radiating elements equally spaced around the ring-shaped array is decreased by one radiating element. Thus, the position of each of original N radiating elements is adjusted to accommodate removal of one radiating element. The N−1 radiating elements are equally spaced about the periphery of the ring-shaped array.

Figure 7:
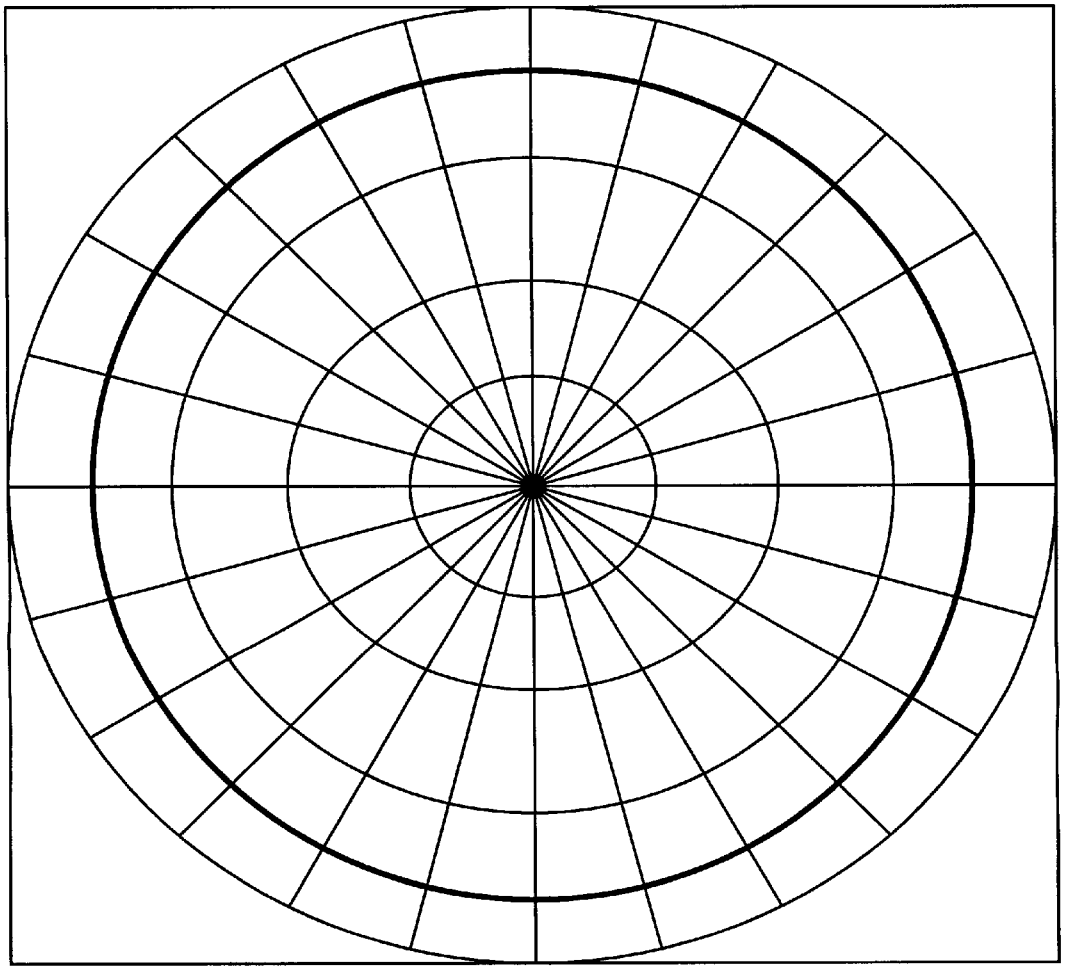
FIG. 7 is a graphic representation of a radiation pattern having a ripple value not greater than a desired ripple value.

With reference next to FIG. 7, a graphic representation of a radiation pattern having a ripple value not greater than the desired ripple value is shown. In the present embodiment, the desired ripple value is plus or minus 0.30 dB. In the embodiment of FIG. 7, 9 radiating elements generate a radiation pattern having a maximum ripple of plus or minus 0 dB. Thus, in step 436 the number of radiating elements in the embodiment of FIG. 7 would be decreased by one radiating element.

Referring again to FIG. 4B, in step 438, the present ORAD system calculates the $E_{field}$ for an array having one less radiating element. The calculation of the $E_{field}$ is accomplished as described in detail above in conjunction with step 416.

Next, in step 440, the present ORAD system calculates the minimum and maximum $E_{field}$ [dB] for the array by subtracting the minimum $E_{field}$ [dB] value from the maximum $E_{field}$ [dB] value.

In step 442, the present ORAD system compares the actual ripple with the desired ripple. That is, the present invention compares the actual ripple determined in step 428 with the desired ripple value which was accessed in step 414.

At step 444, the present invention evaluates whether the actual ripple value obtained using N−1 radiating elements is less than or equal to the desired ripple. If the actual ripple value is less than or equal to the desired ripple value, the present ORAD system repeats step 436 through 444. That is, the present ORAD system continues determining the actual ripple for decreasingly smaller numbers of radiating elements until the actual ripple is not less than or equal to the desired ripple value. Once the actual ripple is not less than or equal to the desired ripple, the present number of radiating elements plus one additional radiating elements is the minimum number of radiating elements needed to achieve desired operating characteristics. Thus, the present ORAD system is able to determine the minimum number of radiating elements required to achieve desired operating characteristics without requiring repeated construction and testing of actual ring-shaped arrays.

Thus, the present invention provides a method and system which determines the required placement of radiating elements about an array in order to achieve desired operating characteristics wherein the method and system does not require repeated experimentation. The present invention further provides a method and system which determines the minimum number of radiating elements required to achieve desired operating characteristics for various circular arrays having respective various structural and functional features.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. In a computer system including a processor coupled to a bus, and a memory unit coupled to said bus for storing information, a computer-implemented method for determining the minimum number of radiating elements required for a circular array of radiating elements to have particular operating parameters comprising the computer-implemented steps of:

a) receiving user input indicating an operating frequency for a circular array of radiating elements adapted to generate radiation having a wavelength;

b) receiving user input indicating a desired ripple value for said radiation;

c) receiving user input indicating a circumference of said circular array of radiating elements;

d) determining the number of radiating elements required to space said radiating elements about the periphery of a circle having said circumference such that adjoining radiating elements are separated by not more than one half of said wavelength;

e) calculating the ripple generated by said radiation by calculating maximum and minimum electric field strength generated by a circular array of radiating elements having a number of radiating elements equal to or one greater than the number of radiating elements determined in step d.);

f) comparing said ripple calculated in step e.) with said desired ripple value; and g) determining the minimum number of said radiating elements required to achieve said desired ripple value by adjusting said number of radiating elements so as to obtain an adjusted number of radiating elements, and performing steps e) and f) using said adjusted number of radiating elements until said ripple calculated in step e) is less than or equal to said desired ripple value.

2. The computer-implemented method of claim 1 wherein step c) further comprises the step of:

receiving a diameter of said circular array of radiating elements.

3. The computer-implemented method of claim 2 wherein step c) further comprises the step of:

receiving a number that specifies the circumference of said circular array of radiating elements.

4. The computer-implemented method of claim 1 wherein step d) further comprises the steps of:

calculating the number of radiating elements required to space said radiating elements about said periphery of a circle having said circumference by a distance which is no greater than one half the distance of said wavelength and rounding said calculated number of radiating elements to the nearest integer;

if said nearest integer number of said calculated number of said radiating elements is an even number, adding an additional element to said nearest integer number of said calculated number of said radiating elements; and if said nearest integer number of said calculated number of said radiating elements is an odd number, using said nearest integer number of said calculated number of said radiating elements as the number of radiating elements of said circular array of radiating elements.

5. The computer-implemented method of claim 1 wherein step e) further comprises the step of:

calculating the maximum and minimum electric field strength generated by a circular array of radiating elements equally spaced about the periphery of a circle and having a number of radiating elements equal to or one greater than the number of radiating elements determined in step d) over 360 degrees.

6. The computer-implemented method of claim 1 wherein step g) further comprises the step of:

increasing said number of radiating elements used in the calculation of ripple according to step e) so as to obtain an adjusted number of radiating elements when said ripple calculated in step e) is greater than said desired ripple value and repeating steps e) through f) using said adjusted number of radiating elements until said ripple calculated in step e) is not greater than said desired ripple value.

7. The computer-implemented method of claim 1 wherein step g) further comprises the steps of:

decreasing said number of radiating elements used in the calculation of ripple according to step e) so as to obtain an adjusted number of radiating elements when said ripple calculated in step e) is less than or equal to said desired ripple value and repeating steps e) through f) using said adjusted number of radiating elements until said ripple calculated in step e) is not less than or equal to said desired ripple value; and increasing said adjusted number of radiating elements by one element once said adjusted number of radiating elements generates a ripple calculated in step e) which is not less than or equal to said desired ripple value.

8. In a computer system a method for determining the minimum number of radiating elements required to achieve desired operating characteristics for a circular array of radiating elements comprising the steps of:

a) receiving user input indicating an operating frequency for a circular array of radiating elements adapted to generate radiation having a wavelength;

b) receiving user input indicating a desired ripple value for said radiation;

c) receiving user input indicating a circumference of said circular array of radiating elements;

d)_determining the number of radiating elements required to equally space said radiating elements about the periphery of a circle having said circumference such that a circular array of radiating elements is generated, said radiating elements equally spaced apart from each other by a distance which is no greater than one half the distance of said wavelength;

e) calculating the ripple generated by said radiation by calculating maximum and minimum electric field strength generated by a circular array of radiating elements having a number of radiating elements equal to or one greater than the number of radiating elements determined in step d);

f) comparing said ripple calculated in step e) with said desired ripple value; and g) determining the minimum number of said radiating elements required to achieve said desired ripple value by adjusting said number of radiating elements so as to obtain an adjusted number of radiating elements, and performing steps e) and f) using said adjusted number of radiating elements until said ripple calculated in step e) is less than or equal to said desired ripple value.

9. The method of claim 8 wherein step d) further comprises the steps of:

calculating the number of radiating elements required to space said radiating elements about the periphery of a circle having said circumference by a distance which is no greater than one half the distance of said wavelength and rounding said calculated number of radiating elements to the nearest integer;

if said nearest integer number of said calculated number of said radiating elements is an even number, adding an additional element to said nearest integer number of said calculated number of said radiating elements; and if said nearest integer number of said calculated number of said radiating elements is an odd number, using said nearest integer number of said calculated number of said radiating elements as the number of radiating elements needed about the periphery of a circle having said circumference.

10. The method of claim 8 wherein step g) further comprises the step of:

increasing said number of radiating elements spaced about said periphery of said circular array when said ripple calculated in step e) is greater than said desired ripple value and repeating steps e) through f) until said ripple calculated in step e) is not greater than said desired ripple value.

11. The method of claim 8 wherein step g) further comprises the steps of:

decreasing said number of radiating elements spaced about said periphery of said circular array when said ripple calculated in step e) is less than or equal to said desired ripple value and repeating steps d) through f) until said ripple calculated in step e) is not less than or equal to said desired ripple value; and increasing said number of radiating elements spaced about said periphery of said circular array by one element once said number of radiating elements generates a ripple calculated in step e) which is not less than or equal to said desired ripple value.

12. A computer-usable medium having computer-readable program code embodied therein for causing a computer to perform the steps of:

a) receiving user input indicating an operating frequency for a circular array of radiating elements adapted to generate radiation having a wavelength;

b) receiving user input indicating a desired ripple value for said radiation;

c) receiving user input indicating a circumference of said circular array of radiating elements;

d) determining the number of radiating elements required to equally space said radiating elements about the periphery of a circle having said circumference such that a circular array of radiating elements is generated, said radiating elements equally spaced apart from each other by a distance which is no greater than one half the distance of said wavelength;

e) calculating the ripple generated by said radiation by calculating maximum and minimum electric field strength generated by a circular array of radiating elements having a number of radiating elements equal to or one greater than the number of radiating elements determined in step d);

f) comparing said ripple calculated in step e) with said desired ripple value; and g) determining the minimum number of said radiating elements required to achieve said desired ripple value by adjusting said number of radiating elements so as to obtain an adjusted number of radiating elements, and performing steps e) and f) using said adjusted number of radiating elements until said ripple calculated in step e) is less than or equal to said desired ripple value.

13. The computer-usable medium of claim 12 wherein step c) further comprises the step of:

receiving a diameter of said circular array of radiating elements.

14. The computer-usable medium of claim 13 wherein step c) further comprises the step of:

receiving a number that specifies the circumference of said circular array of radiating elements.

15. The computer-usable medium of claim 12 wherein step d) further comprises the steps of:

calculating the number of radiating elements required to space said radiating elements about said periphery of said circle by distance which is no greater than one half the distance of said wavelength and rounding said calculated number of radiating elements to the nearest integer;

if said nearest integer number of said calculated number of said radiating elements is an even number, adding an additional element to said nearest integer number of said calculated number of said radiating elements; and if said nearest integer number of said calculated number of said radiating elements is an odd number, using said nearest integer number of said calculated number of said radiating elements as the number of radiating elements needed about said periphery of said circle.

16. The computer-usable medium of claim 12 wherein step e) further comprises the step of:

calculating the ripple generated by said radiation by calculating maximum and minimum electric field strength generated by a circular array of radiating elements over 360 degrees having a number of radiating elements equal to or one greater than the number of radiating elements determined in step d).

17. The computer-usable medium of claim 12 wherein step g) further comprises the step of:

increasing said number of radiating elements spaced about said periphery of said circular array when said ripple calculated in step e) is greater than said desired ripple value and repeating steps e) through f) until said ripple calculated in step e) is not greater than said desired ripple value.

18. The computer-usable medium of claim 12 wherein step g) further comprises the step of:

decreasing said number of radiating elements spaced about said periphery of said circular array when said ripple is less than or equal to said desired ripple value and repeating steps e) through f) until said ripple calculated in step) e) is not less than or equal to said desired ripple value; and increasing said number of radiating elements spaced about said periphery of said circular array by one element once said number of radiating elements generates a ripple calculated in step e) which is not less than or equal to said desired ripple value.

* * * * *